US005153373A

United States Patent [19]

Lips et al.

[11] Patent Number: 5,153,373

[45] Date of Patent: Oct. 6, 1992

[54] WARHEAD

[75] Inventors: Henrik R. Lips, Düsseldorf; Jürgen Böcker, Oberhausen; Peter Tripptrap, Langenfeld; Klaus Weimann, Rummingen, all of Fed. Rep. of Germany

[73] Assignee: Rheinmetall GmbH, Düsseldorf, Fed. Rep. of Germany

[21] Appl. No.: 626,722

[22] Filed: Dec. 14, 1990

[30] Foreign Application Priority Data

Dec. 14, 1989 [DE] Fed. Rep. of Germany ..... 3941245

[51] Int. Cl.[5] ..... F42B 12/10; F42B 12/00

[52] U.S. Cl. ..... 102/476; 102/306; 102/501

[58] Field of Search ..... 102/306-310, 102/476, 501

[56] References Cited

U.S. PATENT DOCUMENTS

| | | | |
|---|---|---|---|
| 3,217,650 | 11/1965 | Paul et al. | 102/306 |
| 3,913,488 | 10/1975 | Dunetz et al. | 102/501 |
| 4,487,130 | 12/1984 | Brattstrom et al. | 102/476 |
| 4,703,695 | 11/1987 | Langer . | |
| 4,862,804 | 5/1989 | Chawla et al. | 102/476 |
| 4,951,572 | 8/1990 | Bocker et al. | 102/476 |

FOREIGN PATENT DOCUMENTS

| | | | |
|---|---|---|---|
| 0105495 | 4/1984 | European Pat. Off. . | |
| 3301148 | 7/1983 | Fed. Rep. of Germany . | |
| 3301150 | 7/1983 | Fed. Rep. of Germany . | |
| 3528371 | 4/1986 | Fed. Rep. of Germany . | |
| 3506225 | 8/1986 | Fed. Rep. of Germany | 102/476 |
| 3402121 | 7/1987 | Fed. Rep. of Germany . | |
| 3831604 | 5/1989 | Fed. Rep. of Germany . | |

*Primary Examiner*—Harold J. Tudor

*Attorney, Agent, or Firm*—Spencer, Frank & Schneider

[57] ABSTRACT

A warhead including a shell which encloses the explosive charge and a projectile forming liner with the liner being disposed so that its circumferential surface lies against an intermediate ring which, in turn, is fastened to the shell. To avoid undefinable spalling effects in the region of the boundary surfaces between the liner and the shell, which could result in asymmetrical tail formation for the projectile produced by the detonative resharping of the liner, the intermediate ring and the liner have the same acoustic impedance.

14 Claims, 1 Drawing Sheet

WARHEAD

BACKGROUND OF THE INVENTION

The present invention relates to a warhead having an explosive surrounded by a casing or shell and a projectile forming liner, with the perimeter or circumference of the liner being disposed at an intermediate ring fastened to the casing.

In the detonative reshaping of liners, undefinable spalling effects are often observed along the edge of the liner; that is, in the region of the boundary surfaces between liner and casing. These effects are particularly great if the liner and casing are not made of the same material. Spalling effects interfere with the symmetrical tail formation of the projectile produced by the detonative reshaping. Moreover, the mass of the projectile is reduced and, accordingly, the kinetic energy of the projectile.

Federal Republic of Germany patent document DE 3,441,693, which is a counterpart to U.S. Pat. No. 4,703,695, discloses a warhead of this type in which intermediate rings are provided with which the thermal expansion between projectile casing and explosive is to be compensated. Measures for reducing the above-mentioned spalling effects are not mentioned in that reference.

SUMMARY OF THE INVENTION

It is therefore an object of the present invention to further develop a warhead of the above-mentioned type so that spalling of the liner in the region of the liner/casing boundary surfaces is avoided.

The above object is generally achieved according to the present invention by a warhead having a shell or casing surrounding the explosive charge, and a projectile forming liner, with the circumference of the liner being disposed at an intermediate ring which, in turn, is fastened to the shell or casing, and with the intermediate ring and the liner having substantially the same acoustic impedance.

According to a preferred feature of the invention embodiments exhibit particularly the intermediate ring is formed of a material with a density $\rho_R$ which is greater than the density $\rho_L$ of the liner material. Moreover, according to further features of the invention, various arrangements of the intermediate ring may be provided. For example the intermediate ring may lie against the inner surface of the casing and be connected with the casing by a force lock. The intermediate ring can also be disposed in a recess at the front edge of the casing abutting its interior, while being connected with the casing by a force or a form lock so as to be secured against axial displacement due to the influence of heat. Additionally, the intermediate ring may be L-shaped in cross section, and arranged so that it surrounds the front end surface of the casing and partially lies against the interior surface of the casing, while being connected with the casing by a force and/or a form lock.

Thus, the present invention is based on the fact that spalling effects are caused primarily by differences in acoustic impedance between the casing and the liner, or by differences in acoustic impedance between the intermediate ring and the liner. The provision, according to the present invention, of an intermediate ring which surrounds the liner over its entire circumference and which is formed of a material having an acoustic impedance corresponding to that of the liner, prevents such spalling effects.

DETAILED DESCRIPTION OF THE PREFERRED EMBODIMENTS

Figure 1:
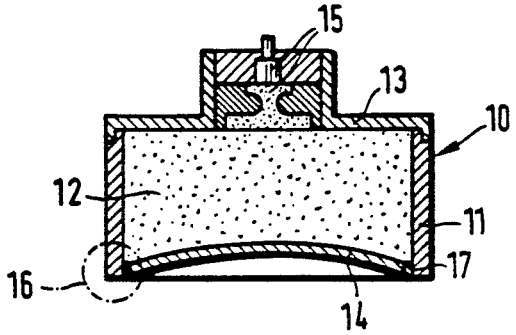
FIG. 1 is a sectional elevational view of a warhead provided with a projectile forming liner and an intermediate ring according to the invention.
Figure 2:
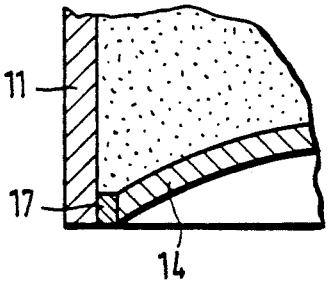
FIG. 2 is a partial sectional view showing the arrangement of the intermediate ring of FIG. 1 at an enlarged scale.

Turning to FIGS. 1 and 2, reference numeral 10 identifies a warhead according to the invention. Warhead 10 includes a cylindrical shell or casing 11 surrounding an explosive charge 12. At one end, shell or casing 11 is provided with a cover 13, and at the opposite end, casing 11 is provided with a projectile forming liner 14 which covers the charge 12. In a known manner, explosive 12 in warhead 10 is ignited by a conventional transfer and booster charge 15 to cause a projectile to be formed from the liner 14. In a transition region 16 between liner 14 and casing 11 an intermediate ring 17 is disposed. FIG. 2 is a detailed illustration of region 16, on an enlarged scale.

As can be seen in FIG. 2, intermediate ring 17 is disposed at the peripheral or circumferential surface of the liner 14, and lies against the inner surface of the shell or casing 11. The intermediate ring 17, according to the invention, is formed from a material having an acoustic impedance which is substantially the same as the acoustic impedance of the material forming liner 14. Moreover, the material forming ring 17 can have a density greater than the density of the material forming liner 14. In the embodiment shown in FIG. 2, the ring 17 is fastened to the inner surface of the shell 11 by a force lock, e.g. a friction or press fit.

Figure 3:
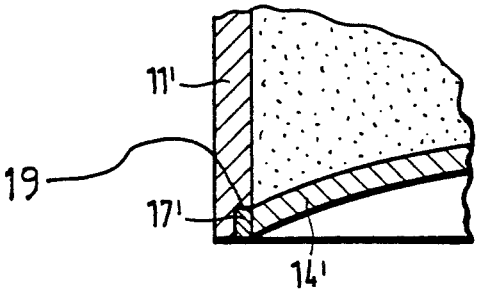
FIGS. 3 and 4 are partial sectional views, similar to FIG. 2, of further embodiments of the intermediate ring arrangement according to the invention.

FIG. 3 shows a further embodiment of the invention in which, in the transition region between a liner 14' and a casing 11', an intermediate ring 17' is disposed in a circumferential recess or groove 19 which is formed in the inner surface of the shell 11' adjacent its end surface and which has a size and shape corresponding to that of the ring 17'. Intermediate ring 17' lies against, and is connected to, the front edge of shell or casing 11' by a force and/or a form lock. A particular advantage of this embodiment is that the intermediate ring 17' is secured against axial displacement due to the influence of heat (for example, the heat present when the explosive charge 12 is cast).

Figure 4:
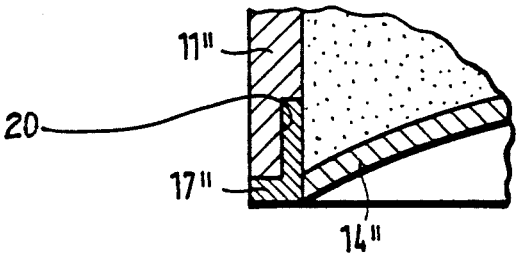

FIG. 4 shows a further embodiment of the a ring arrangement according to the invention, in which an L-shaped intermediate ring 17'' is provided. The ring 17'' is received particularly in an appropriately shaped circumferential recess 20 formed in the inner surface of the shell 11'' adjacent its front end or edge surface, and extends over and surrounds the front edge surface of the casing or shell 11''. In this embodiment as well, intermediate ring 17'' may be, connected with casing 11'' by a force and/or a form lock.

Figure 5:
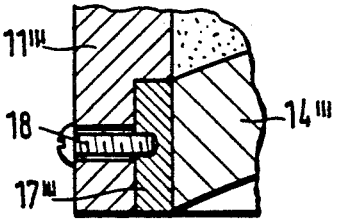
FIG. 5 is a partial sectional view of another embodiment of the invention in which the intermediate ring is fastened to the shell with the aid of a screw.

One embodiment of a releasable or non-releasable form lock connection for an intermediate ring 17''' with a casing 11''' is shown in FIG. 5. According to FIG. 5, which shows a ring arrangement similar to FIG. 3, the ring 17''' is fastened or connected to the shell 11''' by a rod-like member, e.g. a screw 18, which extends through a bore in the shell 11''' into a blind bore in the ring 17''', in this case a threaded blind bore. Other rod-like connector members, such as pins or rivets, also may be used. It is to be understood that the form-lock arrangement of FIG. 5 can likewise be used with the ring arrangement of FIG. 4.

According to the present invention, the intermediate rings 17, 17', 17'', and 17''' and respectively associated liners 14, 14', 14'' and 14''', have substantially the same acoustic impedance, if possible, as damage or irregular spalling of the projectile tail occurs all the more frequently the greater the difference in acoustic impedance; that is, the greater the acoustic reflection coefficient or acoustic reflectivity.

The following table shows the acoustic reflection coefficients for several metal combinations (the respective upper value represents the acoustic reflection coefficient for transverse waves and the lower value the acoustic reflection coefficient for longitudinal waves).

| | | | | | | |
|---|---|---|---|---|---|---|
| Fe | | | | | | |
| Cu | 0.108 | | | | | |
| | 0.051 | | | | | |
| Ta | 0.146 | 0.251 | | | | |
| | 0.214 | 0.262 | | | | |
| W | 0.375 | 0.464 | 0.242 | | | |
| | 0.375 | 0.418 | 0.175 | | | |
| Ni | 0.020 | 0.128 | 0.126 | 0.357 | | |
| | 0.046 | 0.097 | 0.170 | 0.334 | | |
| Mo | 0.175 | 0.278 | 0.029 | 0.214 | 0.155 | |
| | 0.191 | 0.240 | 0.024 | 0.198 | 0.146 | |
| Al | 0.498 | 0.412 | 0.601 | 0.736 | 0.513 | 0.619 |
| | 0.454 | 0.412 | 0.609 | 0.708 | 0.490 | 0.490 |
| | Fe | Cu | Ta | W | Ni | Mo |

The table shows that combinations of Fe and Cu, of Fe and Ni, and of Ta and Mo exhibit a very low reflection behavior, while the combinations of Al and W, as well as of Al and Mo exhibit an extremely high reflection behavior. Material combinations in which the density $\rho_R$ of the ring 17 is greater than the density $\rho_L$ of the associated liner 14 are of particular advantage since this results in increased performance due to the greater damming effect at the edge of the liner 14. This gives the projectile formed from the liner 14 a greater initial or departure velocity and thus greater kinetic energy.

In an embodiment reduced to practice in which a Ta liner 14 was employed in an Fe casing or shell 11, the spalling effect at the tail of the formed projectile was able to be reduced to zero by pressing fitting in impedance matching rings 17 made of Ta. The thickness of the Ta impedance matching rings 17 was varied between 1 and 3 mm.

In a manner similar to that in which ring 17 is fastened to the inner surface of shell 11, as stated above, the connection between the liner 14 and the ring 17 can likewise be a press or friction fit, or a form locking fit, such as a thread connection.

It will be understood that the above description of the present invention is susceptible to various modifications, changes, and adaptations, and the same are intended to be comprehended within the meaning and range of equivalents of the appended claims.

What is claimed is:

1. A warhead comprising:

a cylindrical shell having a cover at one end, and a circumferential recess provided in an inner surface of said shell at its other end;

an explosive charge disposed in said shell;

a projectile forming liner disposed in said shell at said other end and covering said explosive charge;

an intermediate ring disposed between a circumferential surface of said liner and said shell, and completely within said recess in a radial direction;

fastening means for securing said ring to said shell to resist axial displacement under the influence of heat; and wherein said intermediate ring and said liner are formed of different materials which have substantially the same acoustic impedance, with said liner being formed of a material having a first density, said ring being formed of a material having a second density, and said second density being greater than said first density.

2. A warhead as defined in claim 1, wherein said fastening means for securing said ring to said shell comprises a force lock.

3. A warhead as defined in claim 1, wherein said fastening means comprises a rod-like member extending via a throughbore in said shell into a blind bore in said ring.

4. A warhead as defined in claim 3 wherein said rod-like member of said fastening means is one of a screw, a pin and a rivet.

5. A warhead as defined in claim 1, wherein: said ring has a substantially L-shaped cross section; said ring is disposed in said recess and extends over and abuts an end surface of said shell at said other end of said shell; and said fastening means comprises at least one of a force lock and a form lock.

6. A warhead comprising:

a cylindrical shell having a cover at one end, and a circumferential recess provided in an inner surface of said shell at its other end;

an explosive charge disposed in said shell;

a projectile forming liner disposed in said shell at said other end and covering said explosive charge;

an intermediate ring disposed between a circumferential surface of said liner and said shell, and completely within said recess in a radial direction;

fastening means for securing said ring to said shell to resist axial displacement under the influence of heat; and wherein said intermediate ring and said liner are formed of different materials which have substantially the same acoustic impedance.

7. A warhead as defined in claim 6, wherein said fastening means for securing said ring to said shell comprises a force lock.

8. A warhead as defined in claim 6, wherein said fastening means comprises a rod-like member extending via a throughbore in said shell into a blind bore in said ring.

9. A warhead as defined in claim 8 wherein said rod-like member of said fastening means is one of a screw, a pin and rivet.

10. A warhead as defined in claim 6, wherein: said ring has a substantially L-shaped cross section; said ring is disposed in said recess and extends over and abuts an end surface of said shell at said other end of said shell;

and said fastening means comprises at least one of a force lock and a form lock.

11. A warhead as defined in claim 6, wherein said shell and said liner are formed of different materials.

12. A warhead comprising:

a cylindrical shell having an inner surface and a cover at one end;

an explosive charge disposed in said shell;

a projectile forming liner disposed in said shell at its other end and covering said explosive charge;

a circumferential recess provided in said inner surface at said other end of said shell; and, an intermediate ring disposed between a circumferential surface of said liner and said shell and fastened to said shell, said intermediate ring being disposed completely within said recess in a radial direction and having an acoustic impedance which is substantially the same as the acoustic impedance of said liner.

13. A warhead as defined in claim 12 further comprising fastening means for securing said intermediate ring to said shell to resist axial displacement under the influence of heat.

14. A warhead as defined in claim 12 wherein: said intermediate ring has a substantially L-shaped cross section; and said ring is disposed in said recess and has a radially outwardly directed portion which extends over and abuts an end surface of said shell at said other end of said shell.

* * * * *